US011805890B1

(12) United States Patent
Mandeville

(10) Patent No.: US 11,805,890 B1
(45) Date of Patent: Nov. 7, 2023

(54) POCKET CLIP FOR A TOOL

(71) Applicant: A. Mark Mandeville, Mills River, NC (US)

(72) Inventor: A. Mark Mandeville, Mills River, NC (US)

(73) Assignee: Microtech Knives, Inc., Mills River, NC (US)

( * ) Notice: Subject to any disclaimer, the term of this patent is extended or adjusted under 35 U.S.C. 154(b) by 0 days.

(21) Appl. No.: 18/162,109

(22) Filed: Jan. 31, 2023

(51) Int. Cl.
*B26B 1/02* (2006.01)
*A45F 5/02* (2006.01)

(52) U.S. Cl.
CPC ..... *A45F 5/022* (2013.01); *A45F 2200/0575* (2013.01); *B26B 1/02* (2013.01)

(58) Field of Classification Search
CPC .... A45F 2200/0575; A45F 5/02; A45F 5/021; A45F 5/022; B26B 1/02; B26B 1/10; Y10S 224/904
USPC ..... 224/269; D3/215, 220, 99
See application file for complete search history.

(56) References Cited

U.S. PATENT DOCUMENTS

| | | | | |
|---|---|---|---|---|
| 3,590,441 | A | 7/1971 | Goldberg | |
| 4,608,733 | A | 9/1986 | Eylers | |
| 4,797,982 | A | 1/1989 | Eylers et al. | |
| 4,926,525 | A | 5/1990 | Eylers | |
| 5,038,985 | A * | 8/1991 | Chapin | G01B 5/0002 24/3.12 |
| D487,628 | S | 3/2004 | Mathews | |
| 8,028,873 | B2 | 10/2011 | Hawk et al. | |
| 8,783,141 | B2 | 7/2014 | Caswell | |
| 9,815,213 | B2 * | 11/2017 | Duey | B26B 1/048 |
| 2019/0224860 | A1 * | 7/2019 | Alexander | B26B 1/02 |

* cited by examiner

*Primary Examiner* — Nathan J Newhouse
*Assistant Examiner* — Matthew T Theis
(74) *Attorney, Agent, or Firm* — Steve LeBlanc, LLC

(57) ABSTRACT

A pocket clip for a tool includes a mounting section that defines a width between a first side opposed to a second side. A friction section is flexibly connected to the mounting section, and the friction section has a distal end biased toward the tool when the mounting section is attached to the tool. An aperture is through the friction section. A first slot extends from the first side of the mounting section partially across the width of the mounting section, and at least a portion of the aperture through the friction section is aligned in line with the first slot. A first connector in the first slot of the mounting section attaches the mounting section to the tool.

17 Claims, 3 Drawing Sheets

POCKET CLIP FOR A TOOL

FIELD OF THE INVENTION

The present invention generally involves a pocket clip for a tool. In particular embodiments, the tool may be a pocket knife.

BACKGROUND OF THE INVENTION

Many tools include a pocket clip that allows the tool to be carried in or outside of a pocket or belt for convenient access when use of the tool is desired. For example, the pocket clip may allow a user to easily carry the tool in a pocket without requiring the use of either hand. In this manner, the pocket clip may allow the user to conceal some or all of the tool in the pocket so that the tool is not readily visible outside of the pocket. Alternately, the visible portion of the pocket clip outside of the pocket may subtly identify the presence of the tool inside the pocket to others. In addition to performing a function, the design, appearance, profile, and/or size of the pocket clip may complement the overall appearance of the tool. In some instances, the pocket clip may be removable from the tool so the user may swap out pocket clips having different designs or change the position of the pocket clip on the tool to accommodate a preference for left- or right-handed orientation of the pocket clip with respect to the tool.

Pocket clips generally include a mounting section flexibly connected to a friction section. The mounting section of the pocket clip attaches the pocket clip to the tool, and once the mounting section is attached to the tool, the friction section is flexibly biased toward the tool. In this manner, a pocket panel, belt loop, or other item of clothing may slide between the friction section and the tool, and the bias of the friction section toward or against the tool releasably clamps or "clips" the tool to the pocket.

Pocket clips may generally be attached to an end or a side of the tool, and each location of attachment has benefits and disadvantages. For example, attaching the pocket clip to the end of the tool tends to extend the length of the tool, requiring a correspondingly deeper pocket to accommodate the tool. Conversely, attaching the pocket clip to the side of the tool tends to increase the width of the tool and/or interfere with or obstruct the passage of the pocket panel between the pocket clip and the tool. Therefore, the need exists for an improved pocket clip that can releasably attach a tool to a pocket, belt, or other clothing item.

BRIEF DESCRIPTION OF THE INVENTION

Aspects and advantages of the invention are set forth below in the following description, or may be obvious from the description, or may be learned through practice of the invention.

One embodiment of the present invention is a pocket clip for a tool that includes a mounting section that defines a width between a first side opposed to a second side. A friction section has a distal end, and an arcuate section is between the mounting section and the friction section so that the distal end of the friction section is biased toward the tool when the mounting section is attached to the tool. An aperture is through the friction section. A first slot extends from either the first side or the second side of the mounting section partially across the width of the mounting section, and at least a portion of the aperture through the friction section is aligned in line with the first slot. A first connector in the first slot of the mounting section attaches the mounting section to the tool.

An alternate embodiment of the present invention is a pocket clip for a tool that includes a mounting section that defines a width between a first side opposed to a second side. A friction section is flexibly connected to the mounting section, and the friction section has a distal end biased toward the tool when the mounting section is attached to the tool. An aperture is through the friction section. A first slot extends from the first side of the mounting section partially across the width of the mounting section, and at least a portion of the aperture through the friction section is aligned in line with the first slot. A first connector in the first slot of the mounting section attaches the mounting section to the tool.

In yet another embodiment of the present invention, a pocket clip for a tool includes a mounting section that defines a width between a first side opposed to a second side. A friction section overlaps the mounting section, and the friction section has a distal end biased toward the tool when the mounting section is attached to the tool. An aperture is through the friction section. A first slot extends from either the first side or the second side of the mounting section partially across the width of the mounting section, and at least a portion of the aperture through the friction section is aligned in line with the first slot. A first connector in the first slot of the mounting section attaches the mounting section to the tool.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
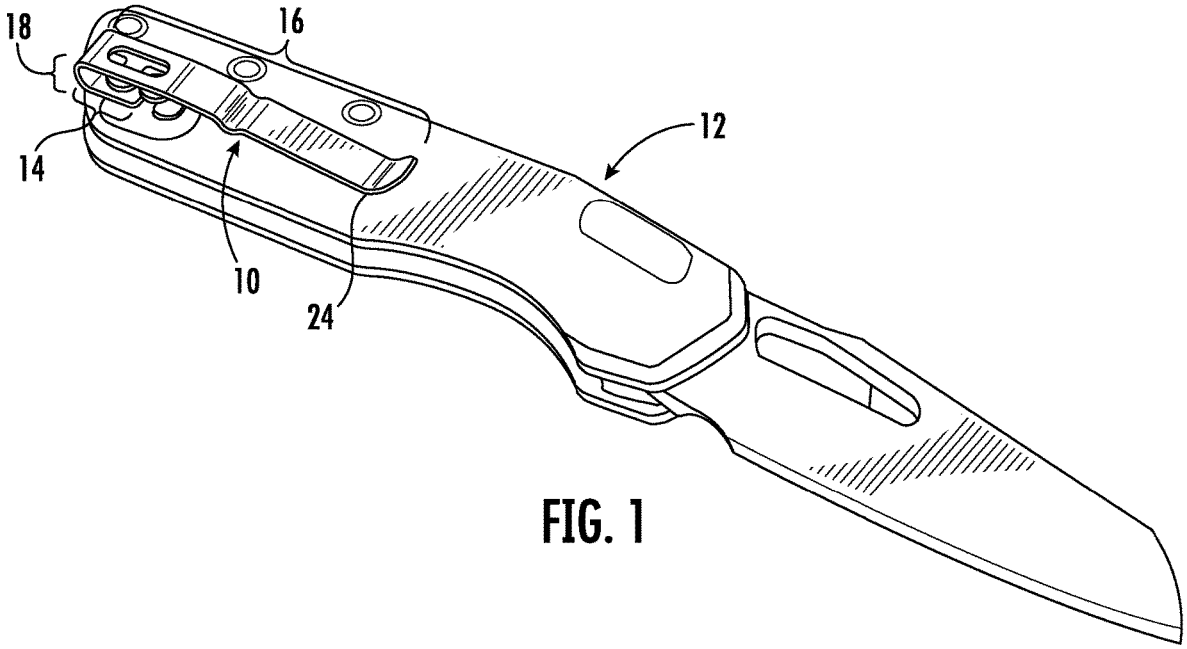
FIG. 1 is a perspective view of a pocket clip according to one embodiment of the present invention attached to a tool.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used in the claims, the definite article "said" identifies required elements that define the scope of embodiments of the claimed invention, whereas the definite article "the" merely identifies environmental elements that provide context for embodiments of the claimed invention that are not intended to be a limitation of the claim.

Figure 2:
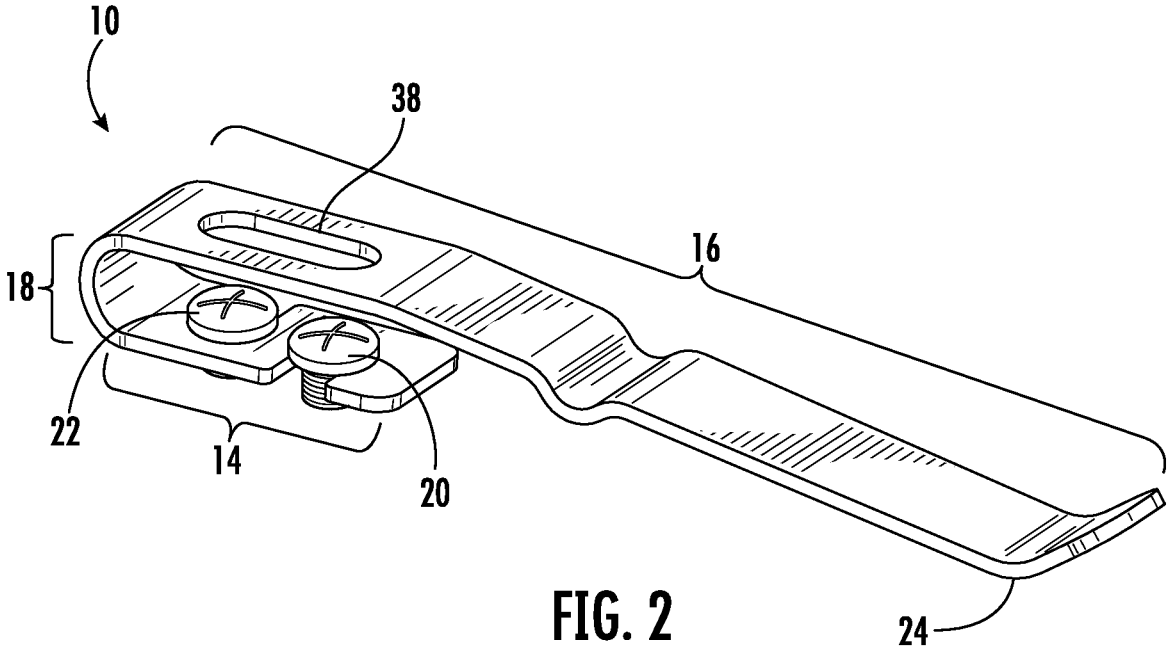
FIG. 2 is a perspective view of the pocket clip shown in FIG. 1.
Figure 3:
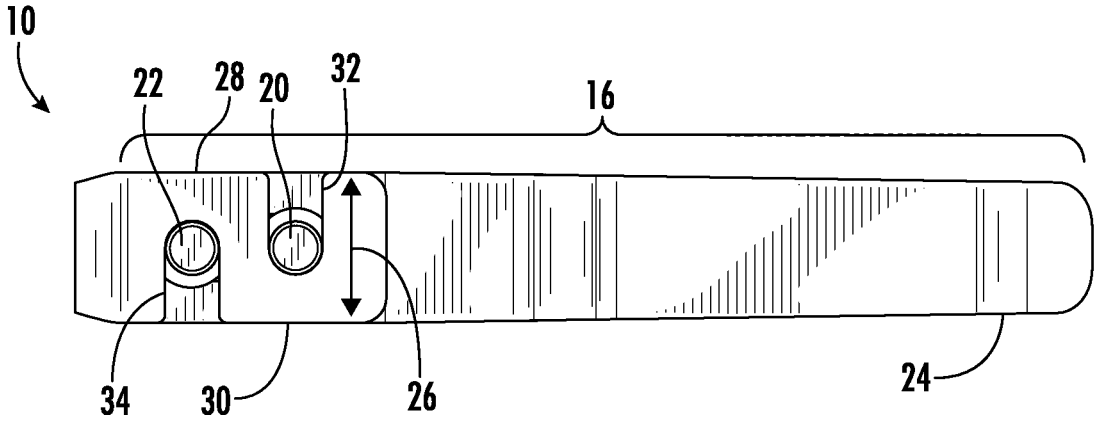
FIG. 3 is a bottom plan view of the pocket clip shown in FIG. 2.
Figure 4:
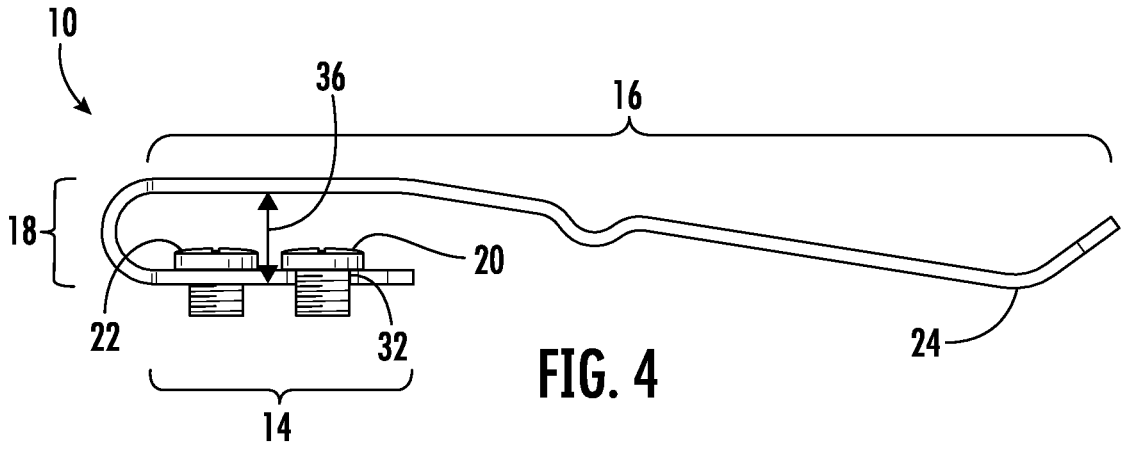
FIG. 4 is a plan view of a first side of the pocket clip shown in FIG. 2.
Figure 5:
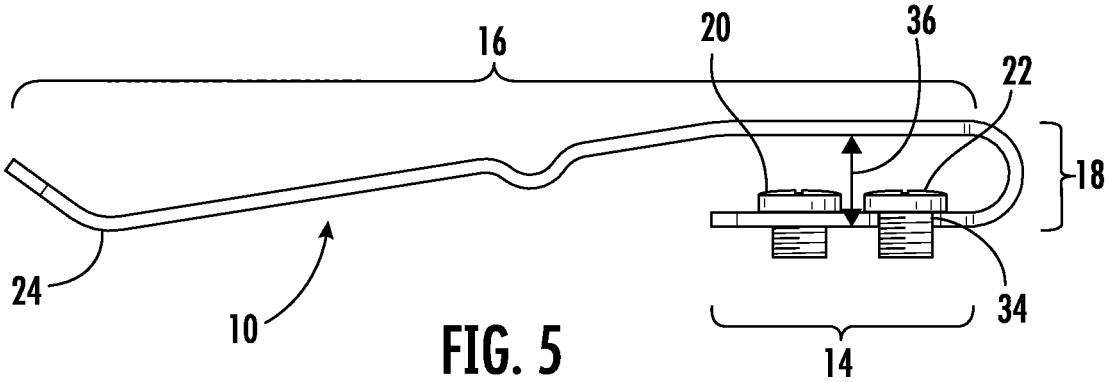
FIG. 5 is a plan view of a second side of the pocket clip shown in FIG. 2.

Embodiments of the present invention include a pocket clip 10 for a tool 12. FIG. 1 provides a perspective view of the pocket clip 10 according to one embodiment of the present invention attached to the tool 12, and FIG. 2 is a perspective view of the pocket clip 10 shown in FIG. 1. Although the tool 12 shown in FIG. 1 is a pocket knife, one of ordinary skill in the art will readily appreciate that the pocket clip 10 may be used with any tool, and the present invention is not limited to any particular tool 12 unless stated in the claims.

As shown in FIGS. 1 and 2, the pocket clip 10 may include a mounting section 14 flexibly connected to a friction section 16. The flexible connection between the mounting section 14 and the friction section 16 may simply be a crimp or clamp between the two sections. Alternately, as shown in the particular embodiment shown in FIGS. 1 and 2, the pocket clip 10 may include an arcuate section 18 between the mounting section 14 and the friction section 16 to provide the flexible connection between the mounting section 14 and the friction section 16 so that the friction section 16 overlays the mounting section 14 along the tool 12. The mounting section 14, friction section 16, and/or arcuate section 18 (if present) may be constructed from plastic, fiberglass, carbon fiber, aluminum, steel, or any other suitable material having the desired strength and flexibility. In addition, the mounting section 14, friction section 16, and arcuate section 18 (if present) may be multiple pieces joined together or a single piece molded, pressed, or bent to the desired shape.

The mounting section 14 provides a suitable surface for attaching the pocket clip 10 to the tool 12. For example, a first connector 20 and/or a second connector 22 may be inserted through the mounting section 14 to fixedly or releasably attach the mounting section 14 to the tool 12. The first and/or second connectors 20, 22 may be screws, rivets, or similar fasteners known in the art for fixedly or releasably connecting objects together.

The friction section 16 provides a suitable surface for clamping or clipping a pocket panel (not shown) between the pocket clip 10 and the tool 12. As shown in FIGS. 1 and 2, the friction section 16 may include a distal end 24 that is biased toward or against the tool 12 when the mounting section 14 is attached to the tool 12. As used herein, the term "distal end" means an area of the friction section 16 that is located away from the flexible connection between the mounting section 14 and the friction section 16 and is not limited to the extreme end of the friction section 16.

FIGS. 3-6 provide bottom, side, and top plan views, respectively, of the pocket clip 10 shown in FIG. 2. As shown most clearly in FIGS. 3-5, the mounting section 14 defines a width 26 between a first side 28 opposed to a second side 30. First and/or second slots 32, 34 may extend from either the first or second sides 28, 30 of the mounting section 14 partially across the width 26 of the mounting section 14. If both first and second slots 32, 34 are present, then the first and second slots 32, 34 may extend from the same or opposite sides 28, 30 of the mounting section 14. As shown most clearly in FIGS. 1, 4, and 5, the first and/or second slots 32, 34 thus provide a clearance 36 between the tool 12 and the friction section 16 that allows the first and second connectors 20, 22 to be inserted between the friction section 16 and the tool 12 without increasing the distance between the mounting section 14 and the friction section 16. As a result, the first and second slots 32, 34 allow for a reduced profile of the pocket clip 10.

Figure 6:
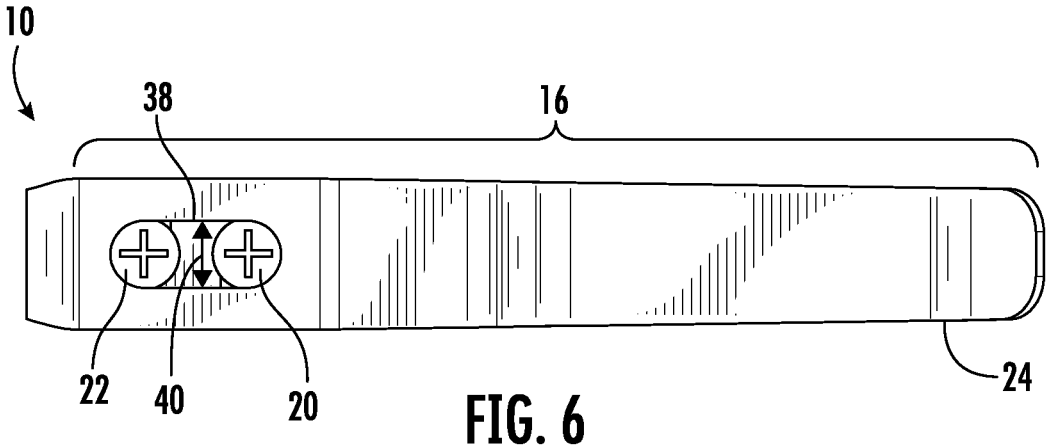
FIG. 6 is a top plan view of the pocket clip shown in FIG. 2.

FIG. 6 provides a top plan view of the pocket clip 10 shown in FIG. 2. As shown in FIGS. 1, 2, and 6, the friction section 16 of the pocket clip 10 includes an aperture 38 through the friction section 16. The aperture 38 is positioned or located on the friction section 16 so at least a portion of the aperture 38 is aligned in line with the first and second slots 32, 34. The position or location of the aperture 38 thus provides access for a screwdriver, rivet gun, or other device to be inserted through the aperture 38 to engage with the first and second connectors 20, 22 positioned in the first and second slots 32, 34 to rotate, crimp, or otherwise secure the first and second connectors 20, 22 to the tool 12.

Although shown as an oval, the particular shape of the aperture 38 is not a limitation of the present invention unless recited in the claims. However, the presence and size of the aperture 38 in the friction section 16 reduces the strength of the friction section 16 and resulting bias of the distal end 24 toward or against the tool 12. Therefore, in particular embodiments, the aperture 38 may have a maximum dimension 40 that prevents the first and second connectors 20, 22 from passing completely through the aperture 38. As used herein, the term "maximum dimension" means a maximum width or length of the aperture 38. As previously discussed with respect to FIGS. 1, 4, and 5, the first and second slots 32, 34 enable the first and second connectors 20, 22 to be inserted between the friction section 16 and the tool 12 before connection to the tool 12, so the first and second connectors 20, 22 may be larger than would otherwise fit through the aperture 36. As a result, the combination of the first and second slots 32, 34 and the limit in the maximum dimension of the aperture 38 allows the use of larger first and second connectors 20, 22 to more securely attach the mounting section 14, and thus the pocket clip 10, to the tool 12 without reducing the strength of the friction section 16 and/or resulting bias of the distal end 24 toward or against the tool 12.

The various embodiments described and illustrated in FIGS. 1-6 enhance the profile and footprint of the pocket clip 10 on the tool 12 without sacrificing the functionality or strength of the pocket clip 10. For example, the alignment of the first and second slots 32, 34 with the aperture 38 in the friction section 16 allows access to the first and second connectors 20, 22 without requiring a wider mounting section 14. In addition, the first and second slots 32, 34 and maximum dimension 40 of the aperture 38 combine to allow for longer and/or larger connectors 20, 22 to facilitate stronger attachment of the mounting section 14, and thus the pocket clip 10, to the tool 12 without increasing the profile of the pocket clip 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A pocket clip for a tool, comprising:

a mounting section, wherein said mounting section defines a width between a first side opposed to a second side;

a friction section, wherein said friction section has a distal end;

an arcuate section between said mounting section and said friction section so that said distal end of said friction section is biased toward the tool when said mounting section is attached to the tool;

an aperture through said friction section;

a first slot that extends from an edge of either said first side or said second side of said mounting section only partially across said width of said mounting section, wherein at least a portion of said aperture through said friction section is aligned in line with said first slot;

a first connector in said first slot of said mounting section that attaches said mounting section to the tool;

wherein said aperture in said friction section has a maximum dimension that prevents said first connector from passing completely through said aperture.

2. The pocket clip for the tool as in claim 1, wherein said arcuate section, said mounting section, and said friction section are a single piece.

3. The pocket clip for the tool as in claim 1, wherein said distal end of said friction section is biased against the tool when said mounting section is attached to the tool.

4. The pocket clip for the tool as in claim 1, further comprising a second slot that extends from either said first side or said second side of said mounting section partially across said width of said mounting section, wherein at least a portion of said aperture through said friction section is aligned in line with said second slot.

5. The pocket clip for the tool as in claim 4, wherein said first and second slots extend from opposite sides of said mounting section.

6. The pocket clip for the tool as in claim 4, further comprising a second connector in said second slot of said mounting section that attaches said mounting section to the tool.

7. A pocket clip for a tool, comprising:

a mounting section, wherein said mounting section defines a width between a first side opposed to a second side;

a friction section flexibly connected to said mounting section, wherein said friction section has a distal end biased toward the tool when said mounting section is attached to the tool;

an aperture through said friction section;

a first slot that extends from an edge of said first side of said mounting section only partially across said width of said mounting section, wherein at least a portion of said aperture through said friction section is aligned in line with said first slot;

a first connector in said first slot of said mounting section that attaches said mounting section to the tool;

wherein said aperture in said friction section has a maximum dimension that prevents said first connector from passing completely through said aperture.

8. The pocket clip for the tool as in claim 7, wherein said friction section and said mounting section are a single piece.

9. The pocket clip for the tool as in claim 7, wherein said distal end of said friction section is biased against the tool when said mounting section is attached to the tool.

10. The pocket clip for the tool as in claim 7, further comprising a second slot that extends from either said first side or said second side of said mounting section partially across said width of said mounting section, wherein at least a portion of said aperture through said friction section is aligned in line with said second slot.

11. The pocket clip for the tool as in claim 10, wherein said first and second slots extend from opposite sides of said mounting section.

12. The pocket clip for the tool as in claim 10, further comprising a second connector in said second slot of said mounting section that attaches said mounting section to the tool.

13. A pocket clip for a tool, comprising:

a mounting section, wherein said mounting section defines a width between a first side opposed to a second side;

a friction section that overlaps said mounting section, wherein said friction section has a distal end biased toward the tool when said mounting section is attached to the tool;

an aperture through said friction section;

a first slot that extends from an edge of either said first side or said second side of said mounting section only partially across said width of said mounting section, wherein at least a portion of said aperture through said friction section is aligned in line with said first slot;

a first connector in said first slot of said mounting section that attaches said mounting section to the tool;

wherein said aperture in said friction section has a maximum dimension that prevents said first connector from passing completely through said aperture.

14. The pocket clip for the tool as in claim 13, wherein said distal end of said friction section is biased against the tool when said mounting section is attached to the tool.

15. The pocket clip for the tool as in claim 13, further comprising a second slot that extends from either said first side or said second side of said mounting section partially across said width of said mounting section, wherein at least a portion of said aperture through said friction section is aligned in line with said second slot.

16. The pocket clip for the tool as in claim 15, wherein said first and second slots extend from opposite sides of said mounting section.

17. The pocket clip for the tool as in claim 15, further comprising a second connector in said second slot of said mounting section that attaches said mounting section to the tool.

* * * * *